US006635986B2

(12) United States Patent
Yaniv et al.

(10) Patent No.: US 6,635,986 B2
(45) Date of Patent: Oct. 21, 2003

(54) FLAT CRT DISPLAY

(75) Inventors: Zvi Yaniv, Austin, TX (US); Ronald Charles Robinder, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 55 days.

(21) Appl. No.: 10/043,479

(22) Filed: Jan. 10, 2002

(65) Prior Publication Data

US 2002/0060517 A1 May 23, 2002

Related U.S. Application Data

(63) Continuation of application No. 09/510,941, filed on Feb. 22, 2000, now Pat. No. 6,411,020, which is a continuation of application No. 09/016,222, filed on Jan. 30, 1998, now Pat. No. 6,441,543.

(51) Int. Cl.[7] ..... H01J 1/02; H01J 1/62

(52) U.S. Cl. ..... 313/495; 313/310; 313/421; 313/351; 313/336

(58) Field of Search ..... 313/306–309, 313/336, 351, 495–497, 421–422, 446–449

(56) References Cited

U.S. PATENT DOCUMENTS

| | | | | |
|---|---|---|---|---|
| 4,955,681 A | * | 9/1990 | Sekihara et al. | 313/495 |
| 4,958,104 A | * | 9/1990 | Suzuki et al. | 313/495 |
| 5,191,217 A | | 3/1993 | Kane et al. | 250/423 |
| 5,231,606 A | | 7/1993 | Gray | 365/225.6 |
| 5,436,530 A | | 7/1995 | Suzuki et al. | 315/169.1 |
| 5,473,218 A | * | 12/1995 | Moyer | 313/309 |
| 5,587,623 A | | 12/1996 | Jones | 313/497 |
| 5,597,338 A | | 1/1997 | Iwai et al. | 445/51 |
| 5,666,019 A | | 9/1997 | Potter | 313/306 |
| 5,763,987 A | | 6/1998 | Morikawa et al. | 313/309 |
| 5,965,977 A | | 10/1999 | Makishima | 313/495 |
| 5,986,388 A | | 11/1999 | Makishima | 313/309 |

FOREIGN PATENT DOCUMENTS

| | | |
|---|---|---|
| DE | 195 34 228 A1 | 3/1997 |
| DE | 197 28 679 A1 | 1/1998 |
| EP | 0 404 022 A2 | 12/1990 |
| EP | 0 479 425 A1 | 4/1992 |
| EP | 0 614 209 A1 | 9/1994 |
| EP | 0 844 642 A1 | 5/1998 |
| EP | 0 899 770 A1 | 3/1999 |

* cited by examiner

*Primary Examiner*—Vip Patel
*Assistant Examiner*—Joseph Williams
(74) *Attorney, Agent, or Firm*—Kelly K. Kordzik; Winstead Sechrest & Minick P.C.

(57) ABSTRACT

A plurality of field emission device cathodes each generate emission of electrons, which are then controlled and focused using various electrodes to produce an electron beam. Horizontal and vertical deflection techniques, similar to those used within a cathode ray tube, operate to scan the individual electron beams onto portions of a phosphor screen in order to generate images. The use of the plurality of field emission cathodes provides for a flatter screen depth than possible with a typical cathode ray tube.

52 Claims, 5 Drawing Sheets

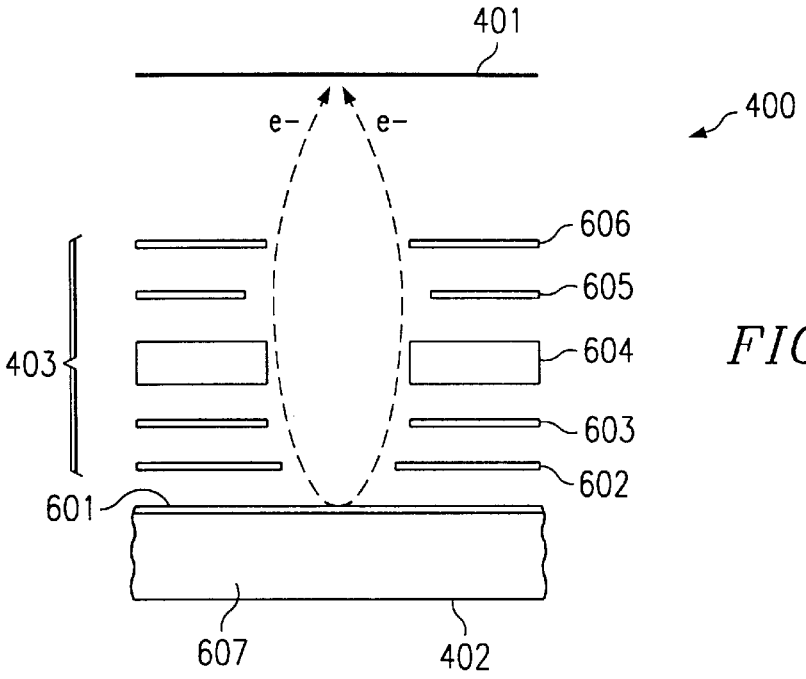
FIG. 6
FIG. 7
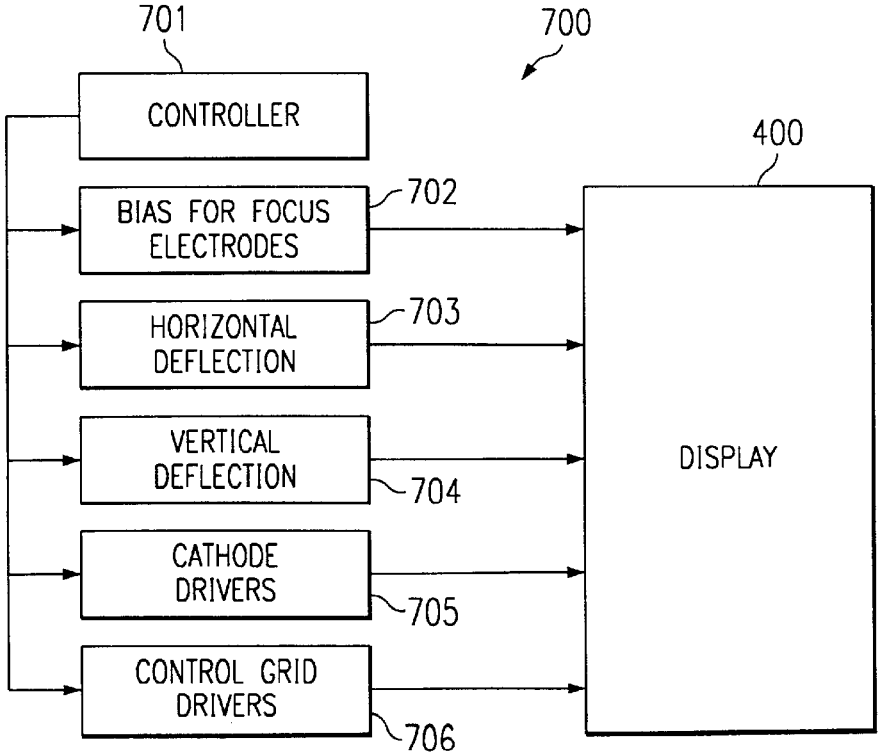

FLAT CRT DISPLAY

This application is a continuation of Ser. No. 09/510,941 filed Feb. 22, 2000, U.S. Pat. No. 6,411,020 which is a continuation of Ser. No. 09/016,222 filed Jan. 30, 1998 U.S. Pat. No. 6,441,543.

TECHNICAL FIELD

The present invention relates in general to displays, and in particular, to field emission displays.

BACKGROUND INFORMATION

The current standard for flat panel display performance is the active matrix liquid crystal display (LCD). However, field emission display (FED) technology has the potential to unseat the LCD, primarily because of its lower cost of manufacturing.

Field emission displays are based on the emission of electrons from cold cathodes and the cathodoluminescent generation of light to produce video images similar to a cathode ray tube (CRT). A field emission display is an emissive display similar to a CRT in many ways. The major difference is the type and number of electron emitters. The electron guns in a CRT produce electrons by thermionic emission from a cathode (see FIG. 1). CRTs have one or several electron guns depending on the configuration of the electron scanning system. The extracted electrons are focused by the electron gun and while the electrons are accelerated towards the viewing screen, electromagnetic deflection coils are used to scan the electron beam across the phosphor coated faceplate. This requires a large distance between the deflection coils and faceplate. The larger the CRT viewing area, the greater the depth required to scan the beam.

FIG. 2 illustrates a typical FED having a plurality of electron emitters or cathodes 202 associated with each pixel on the viewing screen 201. This eliminates the need for the electromagnetic deflection coils for steering the individual electron beams. As a result, an FED is much thinner than a CRT. Furthermore, because of the placement of the emitters in an addressable matrix, an FED does not suffer from traditional non-linearity and pin cushion effects associated with a CRT.

Nevertheless, FEDs also suffer from disadvantages inherent in the matrix addressable design used to implement the FED design. FEDs require many electron emitting cathodes which are matrix addressed and must all be very uniform and of a very high density in location. Essentially there is a need for an individual field emitter for each and every pixel within a desired display. For high resolution and/or large displays, a very high number of such efficient cathodes is then required. To produce such a cathode structure, extremely complex semiconductor manufacturing processes are required to produce a high number of Spindt-like emitters, while the easier to manufacture flat cathodes are difficult to produce with high densities.

Therefore, there is a need in the art for an improved FED.

SUMMARY OF THE INVENTION

The present invention addresses some of the problems associated with matrix addressable FEDs by reducing the number of cathodes, or field emitters, through the use of beam forming and deflection techniques as similarly used in CRTs. Because fewer cathodes are required, the cathode structure will be easier to fabricate. With the use of beam forming and deflection, a high number of cathodes is not required. Furthermore, beam forming and deflection techniques alleviate the requirement that the field emission from the cathode structure be of a high density. Moreover, within any one particular cathode, as field emission sites decay, the display will remain operable since other field emission sites within the particular cathode will continue to provide the requisite electron beam.

A plurality of cathodes will comprise a cathode structure. For each cathode, an electron beam focusing and deflection structure will focus electrons emitted from each cathode and provide a deflection function similar to that utilized within a CRT. A particular cathode will be able to scan a plurality of pixels on the display screen. Software will be utilized to eliminate the overlapping of the beams so that the images produced by each of the cathodes combine to form the overall image on the display.

Any type of field emission cathode may be utilized, including thin films, Spindt devices, flat cathodes, edge emitters, surface conduction electron emitters, etc.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 6 illustrates a sectional view of one cathode in the display of the present invention;

FIG. 7 illustrates a detailed block diagram of a display adapter in accordance with the present invention;

DETAILED DESCRIPTION

Figure 1:
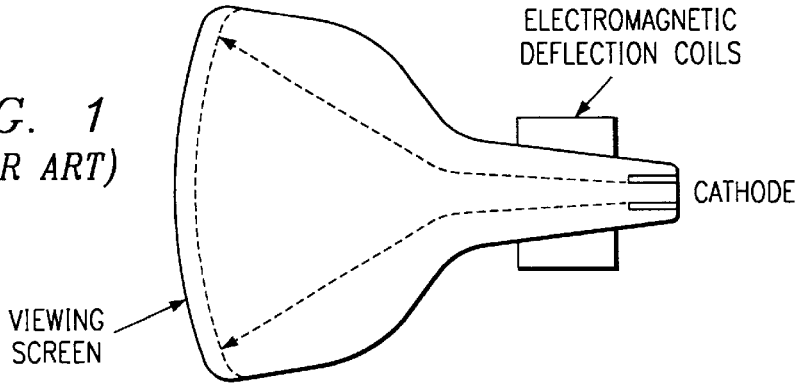
FIG. 1 (PRIOR ART)
FIG. 1 illustrates a prior art CRT.
Figure 2:
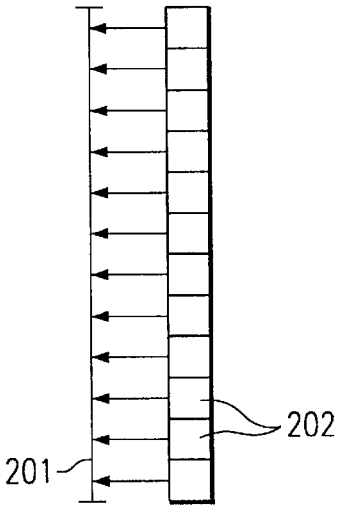
FIG. 2 (PRIOR ART)
FIG. 2 illustrates a prior art FED.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Figure 3:
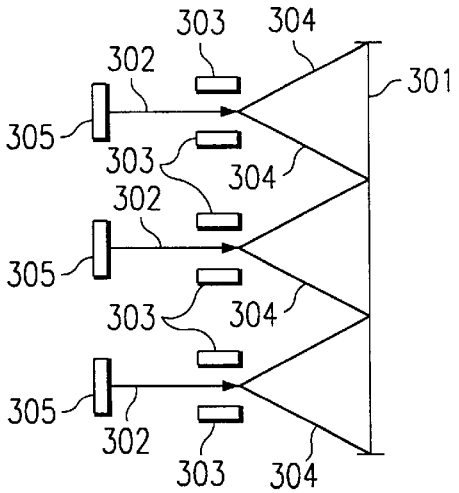
FIG. 3 illustrates a concept of using FEDs with beam deflection.

The present invention combines the technology and advantages associated therewith of FEDs with beam generation and deflection of CRT technology. Though the present invention does not utilize a separate cathode for generating an image on each and every pixel within the display, there are a plurality of cathodes used to generate images on a plurality of pixels by generating and deflecting a beam of electrons generated by a plurality of cathodes. Essentially, the more cathodes utilized, the flatter the display can be. This can be seen by referring to FIG. 3 where a plurality of cathodes 305 each generate a beam of electrons 302, which are deflected by an electron beam deflecting, or focusing, apparatus 303. With this apparatus, a plurality of pixels on display screen 301 can be illuminated by one electron beam 302. The area of pixels on display screen 301 that could be covered with one electron beam 302 is represented by the cone labeled 304.

FED technology is utilized to generate the electron beams because of the various advantages discussed above. The use of FEDs has many advantages over the use of thermionic field emission from a heated cathode. Such use of thermionic emission has been disclosed in U.S. Pat. No. 5,436,530. However, heated cathodes represent a power loss in the system when compared with the use of field emission. The filaments used to heat the cathodes are delicate in nature (fine wires must be used in order to minimize the power required), which are prone to vibration and sagging. Vibration and sagging are typically solved by adding springs and by carefully controlling the detailed shape of the filaments. However, this entails further manufacturing steps and costs and results in a less reliable device. Furthermore, thermal effects resulting from the proximity of the hot filament will cause expansion of various parts of the structure, which will result in changes in the electrical characteristics of the display. Also, use of a cold cathode permits the structure to be partially or wholly manufactured as an integrated device.

Figure 4:
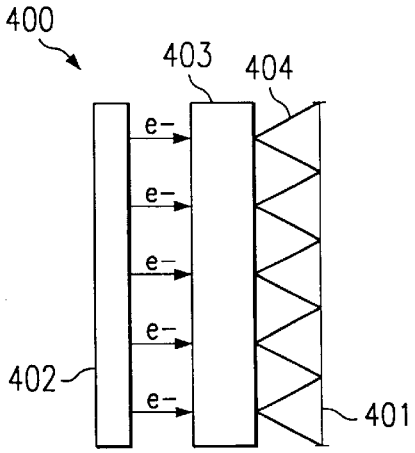
FIG. 4 illustrates a side view of a display configured in accordance with the present invention.

FIG. 4 illustrates display 400 where images are generated on display screen 401 by beam generation and deflection from an FED source 402. The deflection, or focusing, of the various electron beams is performed by beam deflection apparatus 403. The plurality of cones 404 represent the areas on display screen 401 illuminated by each of the generated electron beams. The electron beams generate images by exciting phosphors on display screen 401. The displayed images may be monochrome or in color.

Figure 5:
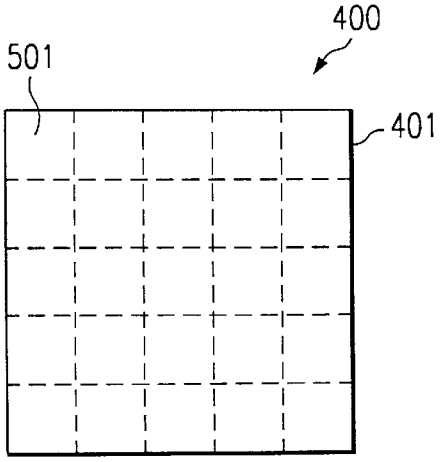
FIG. 5 illustrates a front view of a display configured in accordance with the present invention.

FIG. 5 illustrates a front view of display screen 401. Each area of display screen 401 labeled as 501 represents an image generated by one cathode and its associated electron deflection apparatus. Special software will be utilized to eliminate overlapping of the beams between areas 501 so that the boundaries represented with dashed lines are invisible to the viewer. Such software is not discussed in detail in this application, since it is not important to an understanding of present invention.

FIG. 6 illustrates a cross-sectional view of one cathode 402 and its associated electron focusing and deflection apparatus within display device 400. On substrate 607 a cathode 601 is produced. Such a cathode 601 may comprise micro-tips, edge emission cathodes, negative electron affinity cathodes, diamond and diamond-like carbon films, or surface conduction electron emitters.

Extraction grid 602 operates to extract electrons from cathode 601 as a result of the difference in potential between extraction grid 602 and cathode 601.

Control grid 603 operates to modulate the electron beam current, which will, in turn, modulate the light output.

The electronic optics used to focus the electron beam is shown as 604; however, this may be comprised of a plurality of grids having various potentials applied thereto. Such a plurality of grids is further detailed in FIGS. 9 and 10.

Horizontal deflecting grid 605 and vertical deflecting grid 606 operate in a similar manner as electromagnetic deflection coils in a CRT to scan the electron beam onto the individual pixels on display screen 401.

Figure 9:
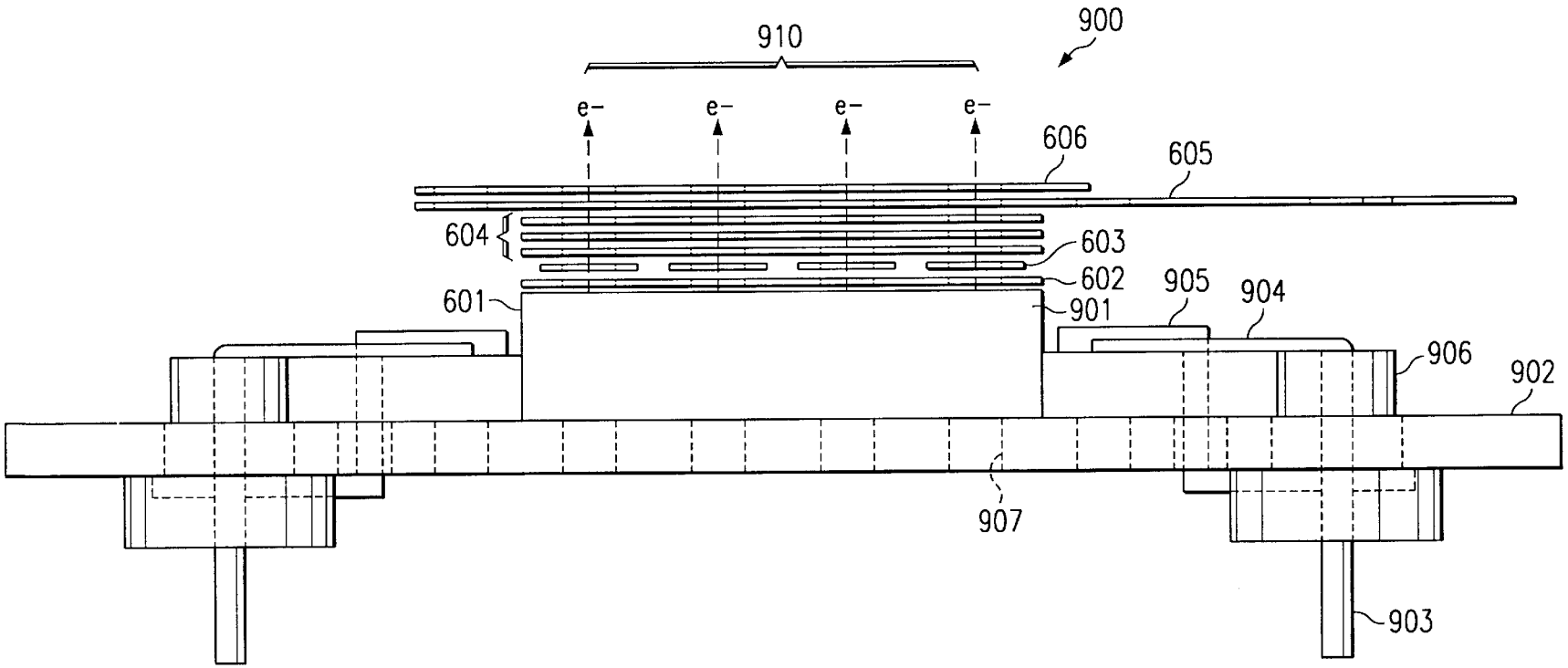
FIG. 9 illustrates a side view of one embodiment of the present invention.
Figure 10:
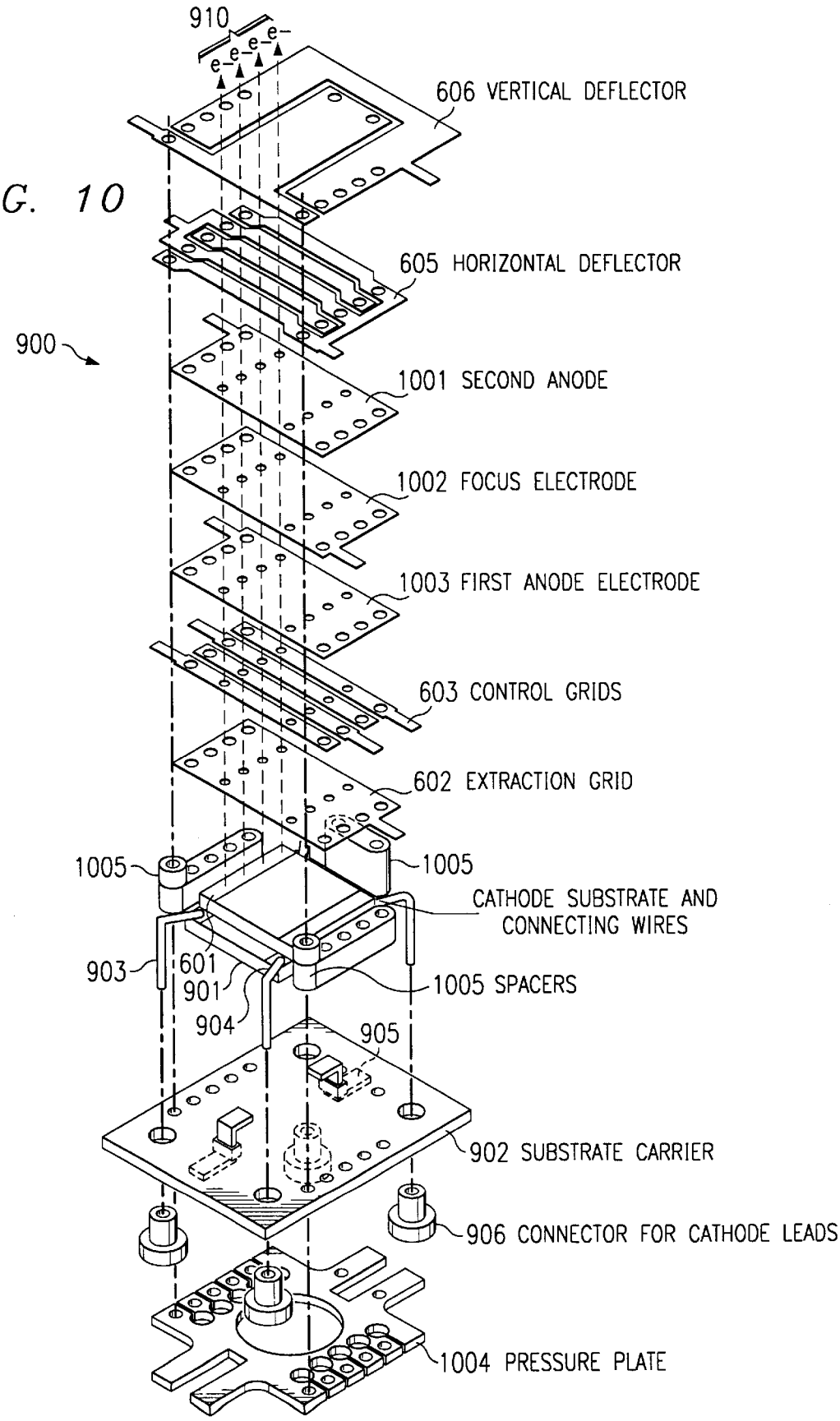
FIG. 10 illustrates an exploded view of the embodiment illustrated in FIG. 9.

One embodiment of the present invention is shown in FIGS. 9 and 10, which illustrate one cathode assembly 900 operable for generating a plurality of electron beams 910 for scanning a plurality of viewing areas 501 on a display screen 401. Shown are electron beams 910 generated on cathode 601. These electron beams are shown with dashed lines. Note that another four electron beams are generated from cathode 601, but these electron beams are not illustrated with dashed lines for reasons of clarity. Furthermore, FIGS. 9 and 10 do not illustrate the spacer elements used to separate the various electrodes and deflectors from each other and from cathode 601. Such spacer elements may be comprised of insulative materials.

Pressure plate 1004 is coupled to substrate carrier 902. Pressure plate is used to provide a medium by which all of the various elements of cathode structure 900 may be connected together, such as through the use of pressure clips. Cathode substrate 901 is positioned on substrate carrier 902 and held in place by clips 905. Spacers 1005 are utilized to provide spacing between several of the various electrodes and deflectors. Further description of pressure plate 1004 and spacers 1005 is not necessary for an understanding of the present invention.

Connection wires 904 provide electric potential to cathode 601 from connecting leads 903, which pass through insulators 906 to the underside of cathode structure 900.

Electron emitting sites are generated on cathode 601 to generate electrons, which are then controlled and focused through the various electrodes, anodes, and deflectors further described below. Note that certain techniques may be utilized to localize the emission sites on specific portions of cathode 601.

As described above, extraction grid 602 assists in extracting electrons from cathode 601, which are passed through holes formed in extraction grid 602. Control grids 603 further assist in the controlling of the electron beams.

The electron focusing apparatus may be comprised of first and second anodes 1003 and 1001 and focus electrode 1002, which may each have their own biasing potentials applied thereto. The electron beams are then passed through the gaps in horizontal deflector 605 and vertical deflector 606, which operate to scan the electron beams in a controlled manner onto display screen 401.

As an alternative embodiment, some or all of the structure illustrated in FIGS. 6, 9 and 10 may be implemented as a monolithic structure using typical deposition, etching, etc. microelectronics manufacturing techniques.

Figure 8:
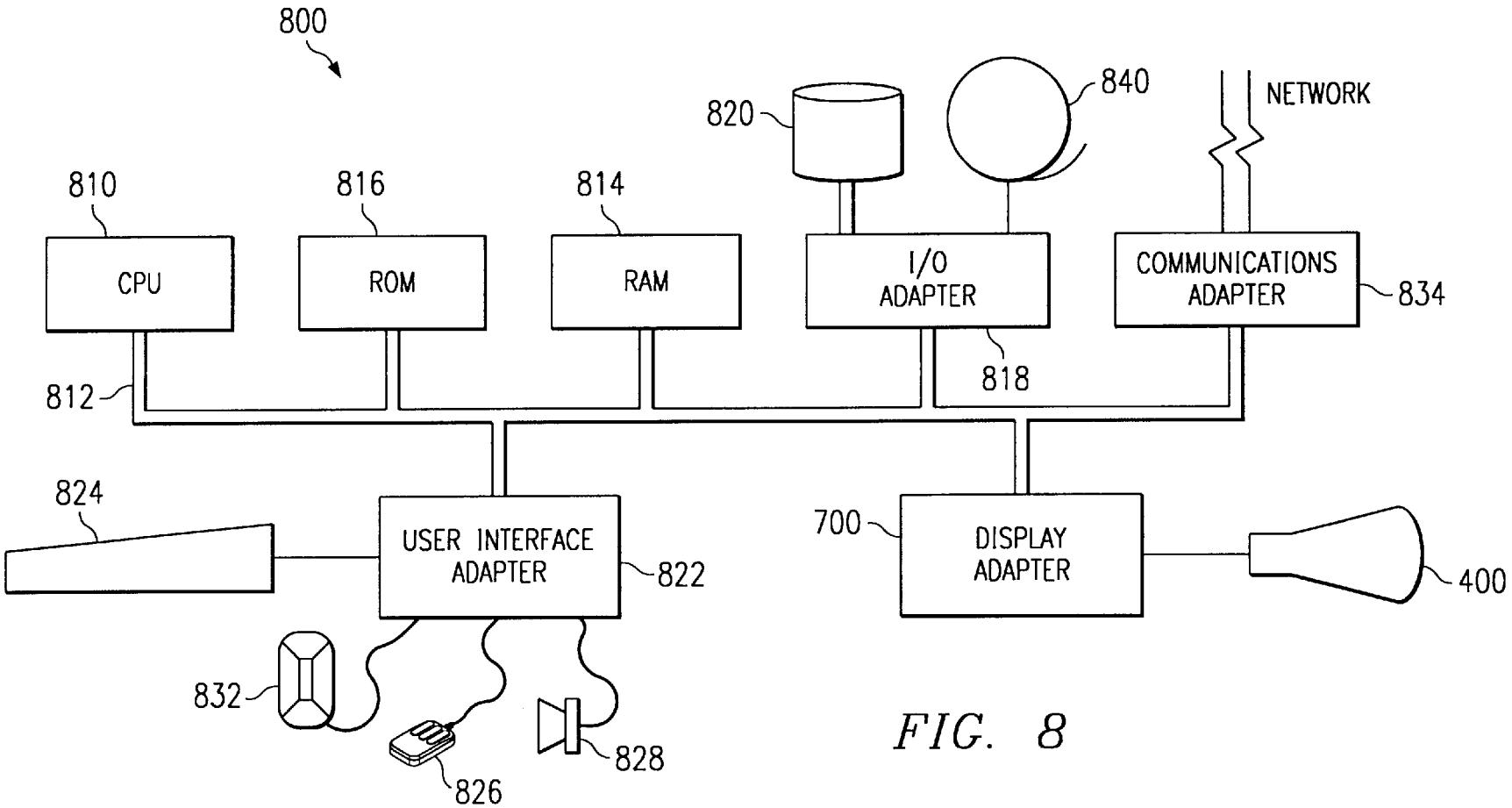
FIG. 8 illustrates a data processing system configured in accordance with the present invention.

Referring next to FIG. 8, there is illustrated data processing system 800 for assisting in the operation of a display 400 in accordance with the present invention.

Workstation 800, in accordance with the subject invention, includes central processing unit (CPU) 810, such as a conventional microprocessor, and a number of other units interconnected via system bus 812. Workstation 813 includes random access memory (RAM) 814, read only memory (ROM) 816, and input/output (I/O) adapter 818 for connecting peripheral devices such as disk units 820 and tape drives 840 to bus 812, user interface adapter 822 for connecting keyboard 824, mouse 826, speaker 828, microphone 832, and/or other user interface devices such as a touch screen device (not shown) to bus 812, communication adapter 834 for connecting workstation 813 to a data processing network, and display adapter 700 for connecting bus 812 to display device 400. CPU 810 may include other circuitry not shown herein, which will include circuitry commonly found within a microprocessor, e.g., execution unit, bus interface unit, arithmetic logic unit, etc. CPU 810 may also reside on a single integrated circuit.

Referring next to FIG. 7, there is illustrated further detail of display adapter 700. Microcontroller 701, will utilize a state machine, hardware, and/or software to operate the plurality of cathodes 400 in order to produce images on display areas 501 on display 400. A portion of electronics 702 will be utilized for biasing the focus electrodes 604. Horizontal and vertical deflection electrodes 606 and 605 will be controlled by blocks 703 and 704, respectively. Cathode driver 705 will operate the various cathodes 601, while control of control grids 603 will be performed by control grid driver 706.

Controller 701 will operate to generate the various images on areas 501 in a manner so that there is no apparent boundary between areas 501, and so that areas 501 operate to generate, either a plurality of separate images 501, or a composite image on the entire display 401. Note that any combination of composite images may be displayed on display screen 401 as a function of display areas 501.

Although the present invention and its advantages have been described in detail, it should be understood that various changes, substitutions and alterations can be made herein without departing from the spirit and scope of the invention as defined by the appended claims.

What is claimed is:

1. A field emission device comprising:

a field emission cathode;

one or more electrodes operable for producing an electric field to promote an emission of electrons from the cathode;

electronic optics operable for creating an electron beam from the emitted electrons;

an electron beam apparatus operable for deflecting the electron beam into a plurality of vectors having diverging angles with respect to each other; and an anode having an electroluminescent material positioned to receive the deflected electron beam, whereby the anode is operable to emit photons in response to bombardment by the electron beam.

2. The cathode structure as recited in claim 1, wherein the cathode comprises one or more microtips.

3. The cathode structure as recited in claim 1, wherein the cathode comprises a flat cathode.

4. The cathode structure as recited in claim 1, wherein the cathode comprises a low work function material.

5. The cathode structure as recited in claim 1, wherein the cathode comprises a surface conduction electron emitter.

6. The cathode structure as recited in claim 1, wherein the cathode comprises an edge emitter.

7. The cathode structure as recited in claim 1, wherein the one or more electrodes includes an extraction electrode and a control grid.

8. The cathode structure as recited in claim 1, wherein the electronic optics includes one or more electrically biased focusing anodes.

9. A field emission cathode structure comprising:

a field emission cathode;

one or more electrodes operable for producing an electric field to promote an emission of electrons from the cathode;

electronic optics operable for creating an electron beam from the emitted electrons; and an electronic beam apparatus operable for focusing and deflecting the electron beam into a plurality of vectors, wherein the electron beam apparatus includes horizontal and vertical deflectors operable for scanning the electron beam through the vectors.

10. A cathode plate comprising a plurality of cathode structures positioned adjacent each other, wherein each of the plurality of cathode structures comprises:

a field emission cathode;

one or more electrodes operable for producing an electric field to promote an emission of electrons from the cathode;

electronic optics operable for creating an electron beam from the emitted electrons; and an electron beam apparatus operable for focusing and deflecting the electron beam into a plurality of vectors, wherein the electron beam apparatus includes horizontal and vertical deflectors operable for scanning the electron beam through the vectors.

11. The cathode plate as recited in claim 10, wherein the cathode comprises one or more microtips.

12. The cathode plate as recited in claim 10, wherein the cathode comprises a flat cathode.

13. The cathode plate as recited in claim 10, wherein the cathode comprises a low work function material.

14. The cathode plate as recited in claim 10, wherein the cathode comprises a surface conduction electron emitter.

15. The cathode plate as recited in claim 10, wherein the cathode comprises an edge emitter.

16. The cathode plate as recited in claim 10, wherein the one or more electrodes includes an extraction electrode and a control grid.

17. The cathode plate as recited in claim 10, wherein the electronic optics includes one or more electrically biased focusing anodes.

18. A display comprising:

a screen having a phosphor layer, the screen portioned into a plurality of pixels; and a cathode plate comprising a plurality of cathode structures positioned adjacent each other, wherein each of the plurality of cathode structures comprises;

a field emission cathode;

one or more electrodes operable for producing an electric field to promote an emission of electrons from the cathode;

electronic optics operable for creating an electron beam from the emitted electrons; and an electron beam apparatus operable for focusing and deflecting the electron beam onto a subplurality of the plurality of pixels.

19. The display as recited in claim 18, wherein the cathode comprises one or more microtips.

20. The display as recited in claim 18, wherein the cathode comprises a flat cathode.

21. The display as recited in claim 18, wherein the cathode comprises a low work function material.

22. The display as recited in claim 18, wherein the cathode comprises a surface conduction electron emitter.

23. The display as recited in claim 18, wherein the cathode comprises an edge emitter.

24. The display as recited in claim 18, wherein the one or more electrodes includes an extraction electrode and a control grid.

25. The display as recited in claim 18, wherein the electronic optics includes one or more electrically biased focusing anodes.

26. The display as recited in claim 18, wherein the electron beam apparatus includes horizontal and vertical deflectors operable for scanning the electron beam onto the portion of the plurality of pixels.

27. A field emission device comprising:

a field emission cathode;

one or more electrodes operable for producing an electric field to promote an emission of electrons from the cathode;

electronic optics operable for creating an electron beam from the emitted electrons; and an electron beam apparatus operable for deflecting the electron beam into a plurality of vectors having diverging angles with respect to each other, wherein the electron beam apparatus is operable for scanning the electron beam through each of the plurality of vectors in a sequential manner.

28. The cathode structure as recited in claim 9, wherein the one or more electrodes include an extraction electrode and a control grid, and wherein the electronic optics include one or more electrically biased focusing anodes.

29. The field emission device as recited in claim 1, wherein the electron beam apparatus is operable for deflecting the electron beam into the plurality of vectors so that a plurality of pixels in the anode receive the deflected electron beam.

30. The field emission cathode structure as recited in claim 9, wherein the horizontal and vertical deflectors are operable for scanning the electron beam through the plurality of vectors to excite photons from a plurality of pixels on an anode positioned a distance away from the cathode structure.

31. The cathode plate as recited in claim 10, wherein the horizontal and vertical deflectors are operable for scanning the electron beam through the plurality of vectors to excite photons from a plurality of pixels on an anode positioned a distance away from the cathode structure.

32. The cathode plate as recited in claim 10, wherein each of the plurality of cathode structures are separately addressable.

33. The cathode plate as recited in claim 32, wherein the plurality of cathode structures are arranged in a matrix of rows and columns.

34. The cathode plate as recited in claim 10, wherein the plurality of cathode structures are positioned relative to each in an x,y matrix.

35. The cathode plate as recited in claim 34, wherein each of the plurality of cathode structures are matrix addressable.

36. The display as recited in claim 18, wherein each of the plurality of cathode structures are separately addressable.

37. The display as recited in claim 36, wherein the plurality of cathode structures are arranged in matrix of rows and columns.

38. The display as recited in claim 18, wherein the plurality of cathode structures are positioned relative to each in an x,y matrix.

39. The display as recited in claim 38, wherein each of the plurality of cathode structures are matrix addressable.

40. A display comprising:

a screen having a phosphor layer, the screen portioned into a plurality of pixels; and a cathode plate, positioned a predetermined distance from the screen, comprising a plurality of cathode structures positioned adjacent each other, wherein each of the plurality of cathode structures comprises;

a field emission cathode;

one or more electrodes for producing an electric field to promote an emission of electrons from the cathode;

electronic optics for creating an electron beam from the emitted electrons; and electron beam apparatus for focusing and deflecting the electron beam onto a portion of the plurality of pixels, wherein the electron beam apparatus is operable for deflecting the electron beam onto a subset plurality of the plurality of pixels.

41. The display as recited in claim 40, wherein the electron beam apparatus is operable for scanning the electron beam in a sequential manner to each of the pixels within the subset plurality of the plurality of pixels.

42. The display as recited in claim 40, wherein each of the plurality of cathode structures is independently controlled.

43. The display as recited in claim 40, wherein the emission of electrons from the cathode in each of the plurality of cathode structures is independently controlled.

44. The display is recited in claim 40, wherein the field emission cathode within each of the plurality of cathode structures emits electrons only towards its corresponding subset plurality of the plurality of pixels.

45. The display as recited in claim 40, wherein the electron beam only comprises electrons emitted from its corresponding field emission cathode.

46. The display as recited in claim 40, wherein the field emission cathode, the one or more electrodes, the electronic optics, and the electron beam apparatus are monolithically integrated with each other.

47. The display as recited in claim 40, wherein the field emission cathode is a cold cathode.

48. The display as recited in claim 40, wherein the field emission cathode, the one or more electrodes, the electronic optics, and the electron beam apparatus are monolithically integrated in an inseparable manner.

49. The display as recited in claim 40, wherein the field emission cathode, the one or more electrodes, the electronic optics, and the electron beam apparatus are assembled as a monolithic integrated circuit.

50. A field emission display comprising:

a substrate;

first, second, third and fourth cold cathodes deposited over the substrate, wherein the first, second, third and fourth cold cathodes are positioned relative to each other in an x,y matrix;

one or more first electrodes for producing a first electric field to transition the first cold cathode from a non-emitting state to an emitting state to produce a first emission of electrons from the first cold cathode;

one or more second electrodes for producing a second electric field to transition the second cold cathode from a non-emitting state to an emitting state to produce a second emission of electrons from the second cold cathode;

one or more third electrodes for producing a third electric field to transition the third cold cathode from a non-emitting state to an emitting state to produce a third emission of electrons from the third cold cathode;

one or more fourth electrodes for producing a fourth electric field to transition the fourth cold cathode from a non-emitting state to an emitting state to produce a fourth emission of electrons from the fourth cold cathode;

first electronic optics for creating a first electron beam from the first emission of electrons;

second electronic optics for creating a second electron beam from the second emission of electrons;

third electronic optics for creating a third electron beam from the third emission of electrons;

fourth electronic optics for creating a fourth electron beam from the fourth emission of electrons;

a display screen positioned a distance from the substrate, wherein the display screen further comprises first, second, third and fourth partitions, each partition having a plurality of pixels;

one or more first scanning electrodes for scanning the first electron beam from the first cold cathode to each of the plurality of pixels in the first partition;

one or more second scanning electrodes for scanning the second electron beam from the second cold cathode to each of the plurality of pixels in the second partition;

one or more third scanning electrodes for scanning the third electron beam from the third cold cathode to each of the plurality of pixels in the third partition; and one or more fourth scanning electrodes for scanning the fourth electron beam from the fourth cold cathode to each of the plurality of pixels in the fourth partition.

51. The field emission display as recited in claim 50, wherein the first electron beam only scans to pixels in the first partition, the second electron beam only scans to pixels in the second partition, the third electron beam only scans to pixels in the third partition, and the fourth electron beam only scans to pixels in the fourth partition.

52. The field mission pay as recited in claim 50, wherein each of the electron beams sequentially scans to each of the pixels in its respective partition.

* * * * *